United States Patent [19]

Miyashita

[11] 4,363,477

[45] Dec. 14, 1982

[54] EXTRA SHEET FEEDER FOR COPYING MACHINE

[75] Inventor: Kiyoshi Miyashita, Hachioji, Japan

[73] Assignee: Olympus Optical Company, Ltd., Tokyo, Japan

[21] Appl. No.: 105,902

[22] Filed: Dec. 21, 1979

[30] Foreign Application Priority Data

Feb. 2, 1979 [JP] Japan ..... 54-11136

[51] Int. Cl.[3] ..... B65H 5/20; B65H 1/04

[52] U.S. Cl. ..... 271/9; 271/117; 271/170; 271/127

[58] Field of Search ..... 271/9, 117, 170, 171, 271/127, 169, 21, 22

[56] References Cited

U.S. PATENT DOCUMENTS

| | | | |
|---|---|---|---|
| 3,285,601 | 11/1966 | Zeuthen | 271/170 |
| 3,319,956 | 5/1967 | Bishop | 271/170 |
| 3,758,105 | 9/1973 | Okamoto | 271/170 |
| 4,097,041 | 6/1978 | Fujimoto | 271/170 |

FOREIGN PATENT DOCUMENTS 2618089 10/1977 Fed. Rep. of Germany ..... 271/9

OTHER PUBLICATIONS

"Priority Insertion Card Mechanism"—IBM Tech. Disclosure, vol. 17, No. 4, Sep. 1974.

*Primary Examiner*—Andres Kashnikow
*Assistant Examiner*—Brian Bond
*Attorney, Agent, or Firm*—Ostrolenk, Faber, Gerb & Soffen

[57] ABSTRACT

An extra sheet feeder in a copying machine includes a positioning member associated with an extra sheet which is to be located in substantial alignment with the leading edge of normal copy sheets disposed in a stack within an associated container of the machine, in a path formed above the stack and along which an extra sheet is inserted. A simple operation of causing one side or the leading edge of the extra sheet to abut against the positioning member permits an extra sheet to be loaded in place and fed using the usual feed mechanism.

20 Claims, 12 Drawing Figures

EXTRA SHEET FEEDER FOR COPYING MACHINE

BACKGROUND OF THE INVENTION

The invention relates to an extra sheet feeder for a copying machine. In general, record sheets having a variety of sizes are provided, and are selectively used to suit a particular use. However, the usual copying machine is provided with a single paper feeder, and hence when it becomes necessary to use a record sheet of a different kind from the kind of record sheets which are already loaded into the copying machine, the loaded sheets must be removed from the machine and a desired record sheet must be loaded anew.

It is pointed out that there is a very strong desire or need to enable a copy to be obtained instantly on a record sheet of a different size from that of record sheets currently loaded in a machine or to obtain dual copies from copying machines which do not have the facility of providing such dual copies.

To accommodate for the need to provide a reduced number of copies of different size or dual copies, a record sheet or sheets are manually loaded into the paper feeder inlet of the machine as an extra sheet or sheets.

There are two types of extra sheet feeding means, one utilizing a devoted feeder which is associated with a separate feeder inlet for receiving an extra sheet or sheets only, and the other receiving the extra sheet into the usual inlet to be fed by the normal feed mechanism.

With feeding means of the former type, a separate feeder inlet must be provided for the extra sheet, which then must be fed by a manual operation, thus unavoidably resulting in a complicated control mechanism of the machine. By contrast, with the latter type, both the construction and the control can be simplified since the existing arrangement can be directly used. As examples of the latter type, U.S. Pat. No. 4,017,181 discloses a copying machine which utilizes a stack of record sheets received in a cassette, but in which when a copying on an extra sheet is desired, the cassette is removed out of the machine with a leading edge of the extra sheet inserted below a separator claw or claws which are provided on the cassette, which is then re-loaded into the machine. On the other hand, British Pat. No. 1,457,117 and U.S. Pat. No. 4,087,178 disclose an arrangement in which the top surface of a cassette which is externally visible when the cassette is loaded is provided with a plurality of indication marks representing a variety of sheet sizes and in which the leading edge of the extra sheet can be aligned with a feed position by aligning the trailing edge of the sheet with one of the indication marks.

In the arrangement of the initially cited U.S. Patent, the cassette must be withdrawn each time an extra sheet is to be loaded, requiring a troublesome operation and preventing an immediate operation. The other or latter arrangement suffers from a problem that it cannot be assured that an extra sheet be loaded in place since the alignment with a selected indication mark cannot be achieved unless sheets of standardized sizes are used or a user may not be aware of the size of an extra sheet being used.

Some copying machines of the prior art are provided with a chamber in which a stack of record sheets of a given size is disposed, instead of using a cassette. When a copy on an extra sheet or a dual copy is desired, again the record sheets in the chamber must be removed, or an extra sheet must be engaged with a separator claw or claws which are provided on the chamber, thus resulting in the difficulty of use.

SUMMARY OF THE INVENTION

It is an object of the invention to eliminate above difficulties of the prior art by providing an extra sheet feeder having a usual feed mechanism which cooperates with an uppermost record sheet disposed in a stack in a sheet container such as a cassette or a containing chamber for feeding sheets one by one and in which an arrangement is made to enable an extra sheet to be loaded in place in a facilitated manner and fed by the normal feed mechanism.

In accordance with the invention, an extra sheet positioning member is disposed in a path which is formed above a stack of record sheets disposed in a container and into which an extra sheet or sheets are inserted. A manual insertion of an extra sheet through an inlet until it bears against the positioning member is all that is required to load it in place in a positive manner. In this manner, the difficulties of the prior art are removed, enabling a rapidly usable, extra sheet feeder to be provided.

DESCRIPTION OF PREFERRED EMBODIMENTS

Figure 1:
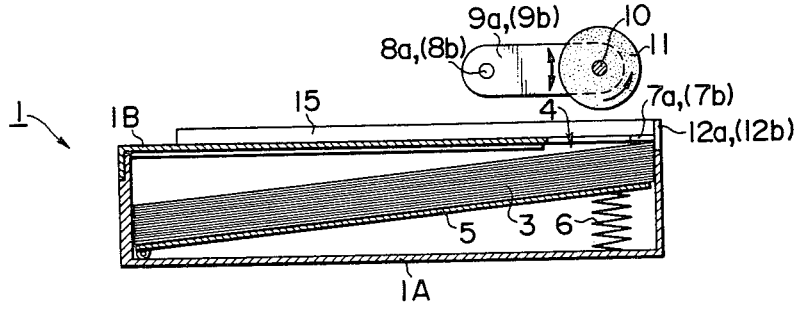
FIG. 1 is a cross section of an extra sheet feeder according to one embodiment of the invention.
Figure 2:
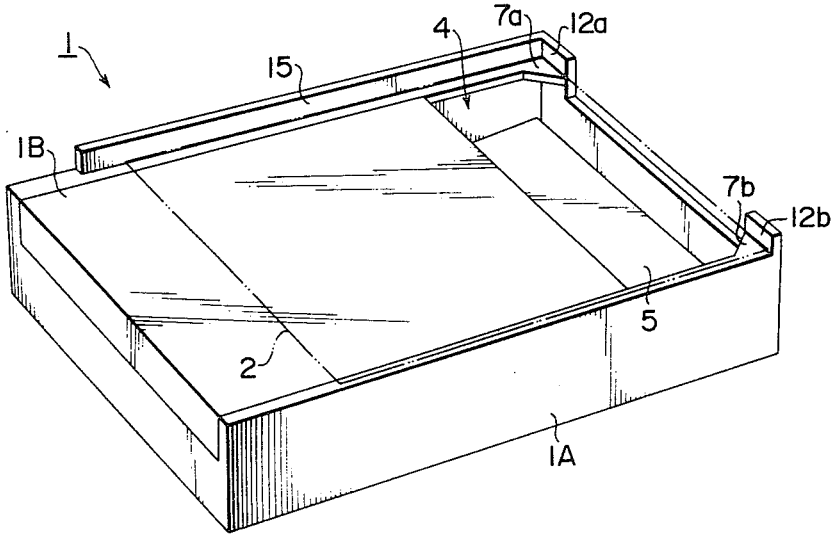
FIG. 2 is a perspective view of a sheet cassette which is used in the feeder shown in FIG. 1.

Referring to FIG. 1, there is shown an extra sheet feeder for a copying machine which is constructed in accordance with one embodiment of the invention. The feeder is designed to permit an extra sheet (see FIG. 2) to be simply loaded into a given position over the top surface of a sheet cassette 1 in which a stack of record sheets 3 are received and are fed one by one by a feed mechanism to enable a copying operation of a copying machine. Specifically, the cassette 1 includes a body 1A which is in the form of a rectangular box. A top cover 1B is detachably disposed on the top thereof. The front end face of the top cover 1B cooperates with the front wall as well as the upper ends of the both lateral sidewalls of the cassette body 1A to define an opening 4 through which record sheets 3 contained within the body 1A are fed one by one by a feed mechanism to be described later, beginning with an uppermost one. It is to be noted that the top portion of the front wall of the body 1A is centrally notched so as to be slightly lower in elevation than the upper end faces of the sidewalls in order to facilitate a feeding operation of the record sheets 3. A placement plate 5 is disposed within the body 1A and a stack of record sheets 3 is placed thereon. The rear end of the placement plate 5 is pivotally mounted on the both lateral sidewalls of the body 1A at its rear bottom ends, and the plate 5 has its front end urged upward by a compression spring 6 which is disposed between the underside of the front end of the plate and the bottomplate of the body 1A for urging the front end of the stack of record sheets 3 disposed thereon in an upward direction. As a result of such bias, an uppermost one of record sheets 3 in the stack has its both lateral ends at the front end thereof disposed in abutment against the underside of a pair of triangular separator claws 7*a*, 7*b* defined at the upper, front corners of the body 1A.

The feed mechanism comprises a pair of rockable roller support arms 9*a*, 9*b* having their one end pivotally mounted on support shafts 8*a*, 8*b* which are in turn mounted on a stationary member of a copying machine, not shown, a drive shaft 10 extending across the other ends of the support arms 9*a*, 9*b* and rotatably supported thereby, and a plurality of feed rollers 11 which are fixedly mounted on the drive shaft 10 in concentric manner therewith. When the drive shaft 10 is driven to rotate the feed rollers 11 counterclockwise while the roller support arms 9*a*, 9*b* are simultaneously rocked clockwise, the feed rollers 11 extend into the opening 4 to bear against an uppermost of the record sheets 3 contained in the cassette 1, whereupon the uppermost record sheet is separated from the remainder of the stack by the action of the separator claws 7*a*, 7*b*. In this manner, the uppermost sheet can be fed by the rotating feed rollers 11 through the opening 4 into the copying machine.

In the extra sheet feeder of this embodiment, a pair of left- and right-hand stops 12*a*, 12*b* are provided at the opposite lateral end of the front end of the cassette body 1A where the claws 7*a*, 7*b* are integrally formed, in the form of extensions of the front wall of the body 1A. These stops define positioning members and serve aligning the leading edge of an inserted extra sheet, shown in phantom line, with the leading edge of the copy sheets 3 contained in the body 1A. A guide ledge 15 is secured to the top of the left-hand sidewall of the body 1A to allow the extra sheet to be positioned along its left-hand side and to guide it when it is being inserted. It will be noted that the ledge 15 is contiguous and integral with the left-hand stop 12*a*.

Figure 3:
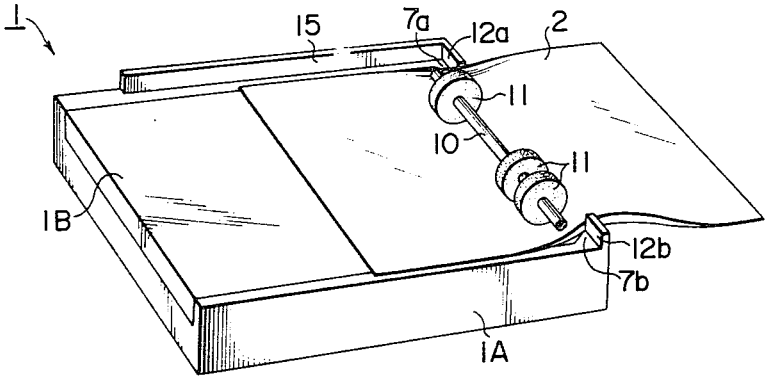
FIGS. 3 and 4 are a perspective view and a front view of the feeder of FIG. 1, illustrating the feeding operation of an extra sheet.
Figure 4:
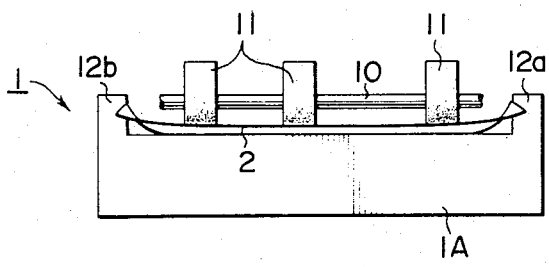

In use, when the cassette 1 is loaded into a copying machine, not shown, the leading edge of the copy sheets 3 contained in the body 1A is invisible. However, the extra sheet or sheets 2 can be accurately loaded in place by inserting them along the guide ledge 15 until their front edge bears against the stops 12*a*, 12*b*. After the extra sheet or sheets 2 are loaded, the roller support arms 9*a*, 9*b* may be rocked clockwise to bring the feed rollers 11 into abutment against the extra sheet 2 which covers the opening 4, thereby feeding the extra sheet into the copying machine as the rollers 11 rotate, as shown in FIGS. 3 and 4. It will be noted from FIG. 4 that the both lateral edges of the extra sheet 2 will be turned upwardly by the stops 12*a*, 12*b* as the sheet is being fed, but it will be appreciated that the rigidity of a copy sheet is usually sufficient to prevent such sheet from being folded or wrinkled.

In this manner, the described embodiment permits an extra sheet 2 to be loaded in place regardless of its size, by merely inserting it until it bears against the stops 12*a*, 12*b* located at the front end of the body 1A which corresponds to the position of the leading edge of normal copy sheets 3 contained in the cassette 1.

Figure 5:
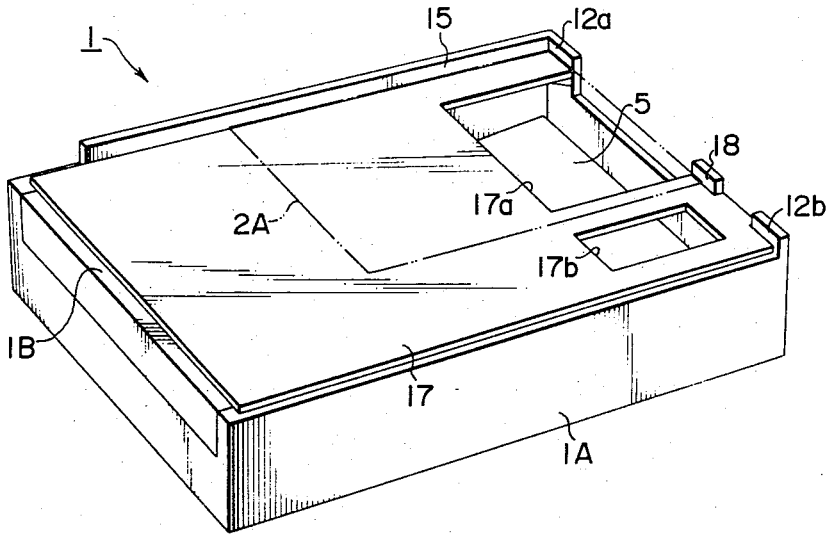
FIG. 5 is a perspective view of the feeder shown in FIG. 1, illustrating an alternative manner which employs an auxiliary placement plate.

As shown in FIG. 5, when an extra sheet 2A has a further reduced size as compared with that of the cassette 1, an auxiliary placement plate 17 may be disposed on top of the cassette 1 so as to extend along the guide ledge 15 and to bear against the stops 12*a*, 12*b*. Subsequently, an extra sheet 2A may be inserted onto the placement plate 17 and along the guide ledge 15 until it bears against the front steps 12*a*, 12*b*. At positions corresponding to the location of the feed rollers 11, the auxiliary placement plate 17 is formed with a notch 17*a* and a through-opening 17*b* to prevent an interference of the plate with these rollers as the latter descend during a normal operation. It is also to be noted that an additional stop 18 is located on the front end of the auxiliary placement plate 17 at a nearly central position, but toward the right-hand side thereof, in order to position the extra sheet 2A by cooperation with the left-hand stop 12*a*. The use of such auxiliary placement plate 17 permits an extra sheet 2A of a further reduced size to be satisfactorily fed.

Figure 6:
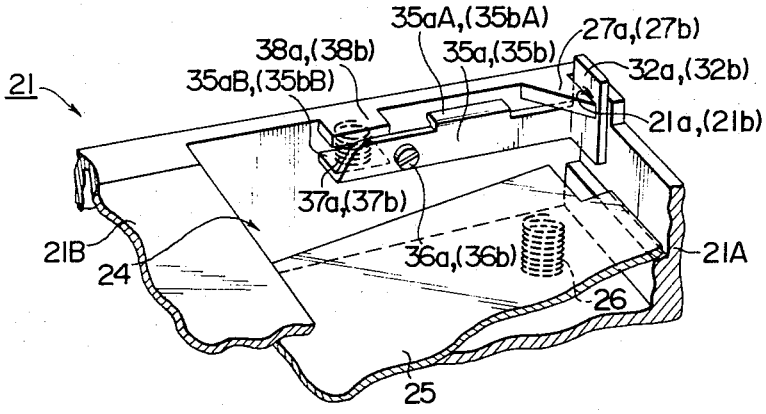
FIG. 6 is a fragmentary perspective view of an extra sheet feeder according to another embodiment of the invention.
Figure 7:
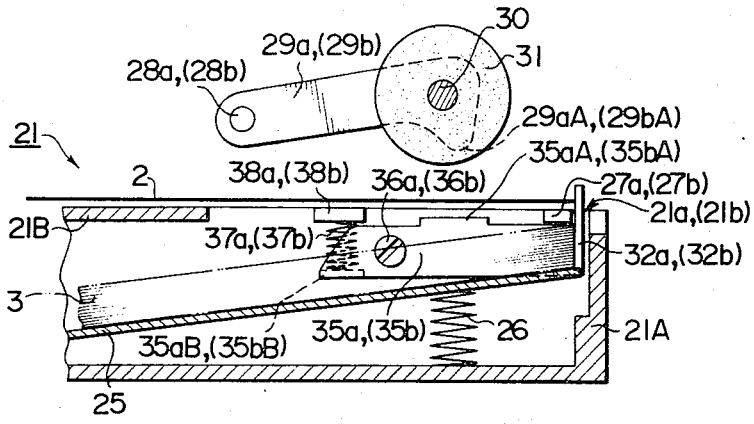
FIGS. 7 and 8 are cross sections of the feeder shown in FIG. 6, illustrating an extra sheet as it is loaded and as it is being fed.
Figure 8:
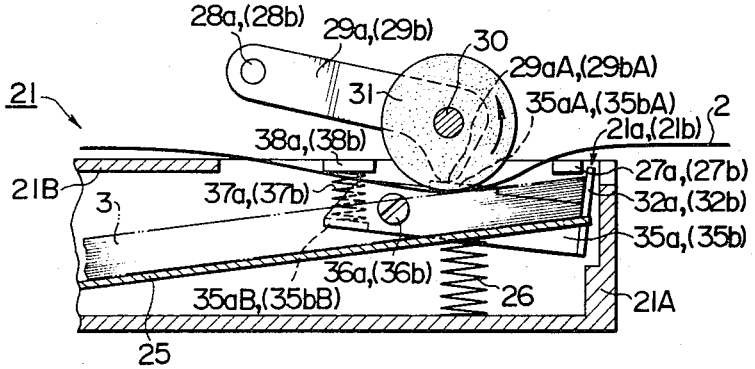

FIGS. 6 to 8 show an extra sheet feeder according to another embodiment of the invention. The feeder is designed to assure a smooth sheet feeding operation by preventing an extra sheet from being turned upwardly by stops. This is achieved by causing extra sheet positioning stops 32*a*, 32*b* to move inwardly or duck into a body 21A of the cassette as feed rollers 31 descend. Specifically, the feeder of this embodiment is provided with a pair of stop support levers 35*a*, 35*b*, each of which is integrally formed with left- and right-hand stop 32*a*, 32*b* and which are adapted to be rocked into the body 21A as the rollers 31 move down. In addition to the stops 32*a*, 32*b* which are folded from the front end of the levers to extend along the front wall of the body 21A, the stop support levers 35*a*, 35*b* include central raised portions 35*a*A, 35*b*A toward the both lateral sidewalls of the body 21A, and also include spring abutments 35*a*B, 35*b*B located at the rear end of the levers 35*a*, 35*b* and which are folded therefrom to extend horizontally toward the both lateral sidewalls of the body 21A. Intermediate its length and toward the rear end, the levers 35*a*, 35*b* are pivotally mounted on the inside of the both lateral sidewalls of the body 21A by means of pivots 36*a*, 36*b*. It will be seen that a pair of triangular separator claws 27*a*, 27*b* as well as a pair of square spring abutments 38*a*, 38*b* extend inwardly and horizontally from the both lateral sidewalls of the body 21A. Notches 21*a*, 21*b* are formed between the separator claws 27*a*, 27*b* and the front wall of the body 21A to receive the stops 32*a*, 32*b* therein. It is to be noted that the spring abutments 38*a*, 38*b* are located in vertical alignment with the spring abutments 35*a*B, 35*b*B formed on the stop support levers 35*a*, 35*b*, and coiled compression springs 37*a*, 37*b* are interposed between these spring abutments, thus urging the stop support levers 35*a*, 35*b* in a direction to drive the stops 32*a*, 32*b* upwardly. However, the resulting movement is limited by the abutment of a front portion of the levers 35*a*, 35*b* against the underside of the separator claws 27*a*, 27*b*, and in this position, the stops 32*a*, 32*b* project above the upper surface of the cassette 21.

Feed rollers 31 are fixedly mounted on a drive shaft 30 which is in turn carried by a pair of rollers support arms 29*a*, 29*b*. It is to be noted that the free end of the arms 29*a*, 29*b* is formed with a downwardly depending bulge 29*a*A, 29*b*A which cooperate with the raised portions 35*a*A, 35*b*A on the levers 35*a*, 35*b*. As the arms 29*a*, 29*b* are rocked clockwise, these bulges 29*a*A, 29*b*A move into abutment against the raised portions 35*a*A, 35*b*A to depress them, thereby rocking the levers 35*a*, 35*b* to cause the stops 32*a*, 32*b* to duck into the cassette 21.

With the extra sheet feeder thus constructed, when the feed rollers 31 are located in their upper position as shown in FIG. 7, the stops 32*a*, 32*b* project above the cassette 21 so that an extra sheet 2 can be easily set in place by inserting it until its leading edge bears against the stops 32*a*, 32*b*. Subsequently, when the feed rollers 31 are brought to their feed position (FIG. 8) where they bear against a stack of record sheets 3 through the extra sheet 2 interposed therebetween, the bulges 29*a*A, 29*b*A on the roller support arms 29*a*, 29*b* cause the stop support levers 35*a*, 35*b* to rock to thereby cause the stops 32*a*, 32*b* to duck into the body 21A, whereby these stops cannot engage the lateral ends of the extra sheet 2 to turn them upwardly, thus assuring a smooth feeding operation for the extra sheet 2.

In FIGS. 6 to 8, a reference character 21B represents a top cover, 24 an inlet for sheets being fed, 25 a placement plate, 26 a coiled spring, and 28*a* and 28*b* pivot pins.

While the feeder shown in FIGS. 6 to 8 is not provided with a guide ledge along the left-hand side of the body 21A for guiding and positioning an extra sheet, it should be understood that such ledge may also be provided in this embodiment. In this instance, it is to be understood that the inner edge of the ledge should be displaced inwardly by an amount corresponding to the thickness of the stop support levers 35*a*, 35*b* so that the left-hand edge of an extra sheet 2 being inserted can be aligned with the left-hand edge of the record sheet 3 which are received in a stack within the body 21A. It is also to be noted that the ledge may also be located along the right-hand edge of the cassette 21.

Figure 9:
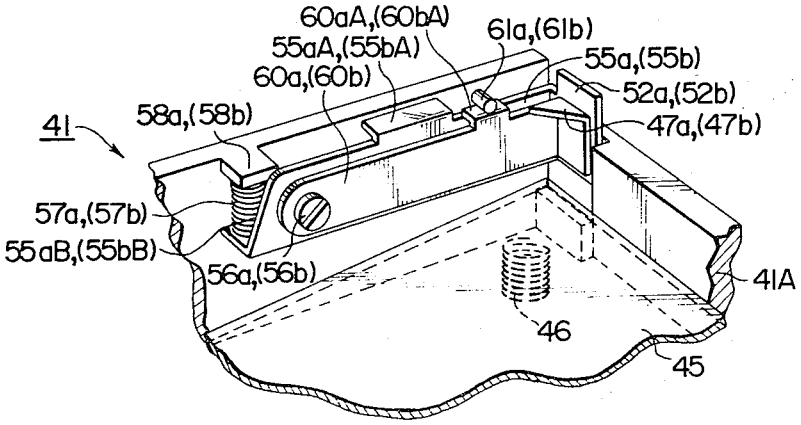
FIG. 9 is a fragmentary perspective view of an extra sheet feeder according to a further embodiment of the invention.
Figure 10:
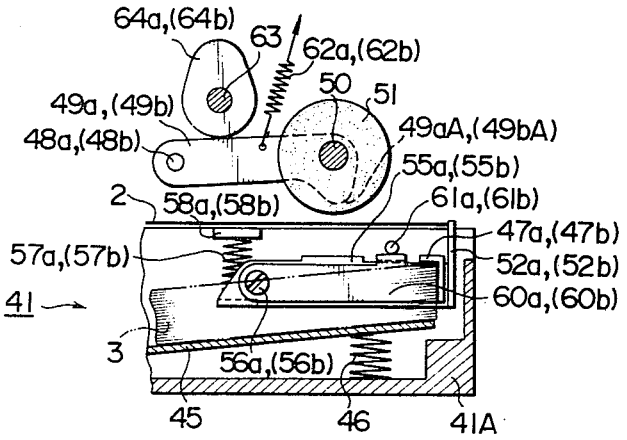
FIGS. 10 and 11 are cross sections of the feeder of FIG. 9, illustrating an extra sheet as it is loaded and as it is being fed.
Figure 11:
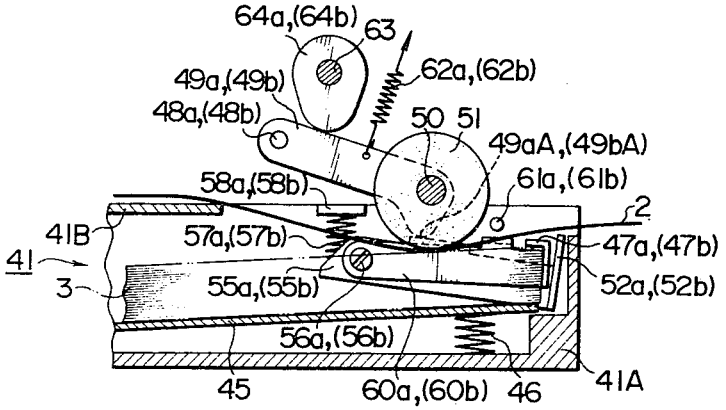

FIGS. 9 to 11 illustrate a further embodiment of the invention where an extra sheet feeder is constructed so that not only stops 52*a*, 52*b* but also separator claws 47*a*, 47*b* move up and down as feed rollers 51 move vertically. Specifically, in the present embodiment, there are provided a pair of stop support levers 55*a*, 55*b* which are constructed in the similar manner as the levers 35*a*, 35*b* shown in FIGS. 6 to 8. These levers 55*a*, 55*b* are pivotally mounted on pins 56*a*, 56*b* on which support arms 60*a*, 60*b* which carry the separator claws are also pivotally mounted. The stop support levers 55*a*, 55*b* include stops 52*a*, 52*b*, raised portions 55*a*A, 55*b*A and spring abutments 55*a*B, 55*b*B. The both lateral sidewalls of body 41A of the cassette are formed with inwardly projecting spring abutments 58*a*, 58*b*, and coiled springs 57*a*, 57*b* are interposed between these spring abutments 58*a*, 58*b* and the spring abutments 55*a*B, 55*b*B to urge the stops 52*a*, 52*b* to project above the top level of the cassette 41. The support arms 60*a*, 60*b* include separator claws 47*a*, 47*b* which comprise a front end of the respective arms folded to extend along the front wall of the body 41A and having a triangular upper projection which is folded back, and also include detent pieces 60*a*A, 60*b*A which are folded from the arms, intermediate their length, toward the both lateral sidewalls of the body 41A. At their rear end, the arms 60*a*, 60*b* are pivotally mounted on the pins 56*a*, 56*b*, on the inside of the stop support levers 55*a*, 55*b*. The detent pieces 60*a*A, 60*b*A engage the upper end faces of the stop support levers 55*a*, 55*b* toward their front end. The upper surface of the detent pieces 60*a*A, 60*b*A is engaged by the lower surface of detent pins 61*a*, 61*b* which project inwardly from the both lateral sidewalls of the body 41A. These pins represent an abutment against the stop support levers 55*a*, 55*b* and the claw support arms 60*a*, 60*b* which are resiliently urged by the coiled springs 57*a*, 57*b*, and also an abutment against a stack of record sheets 3 disposed within the cassette 41 which is upwardly and resiliently urged by the coiled spring 46 through the placement plate 45 and acting upon the separator claws 47*a*, 47*b* and their associated support arms 60*a*, 60*b*.

A pair of roller support arms 49*a*, 49*b* carrying a drive shaft 50 on which feed rollers 51 are fixedly mounted are formed with bulges 49*a*A, 49*b*A on their free end, in the same manner as the roller support arms 29*a*, 29*b* shown in FIGS. 6 to 8. Intermediate their length, these support arms 49*a*, 49*b* are engaged by one end of coiled tension springs 62*a*, 62*b*, which urge the feed rollers 51 to move toward their inoperative position. In response to such bias, the support arms 49*a*, 49*b* then bear against the cam surface of oval-shaped disc cams 64*a*, 64*b* fixedly mounted on a drive shaft 63, and can be rocked in response to a rotation of the disc cams 64*a*, 64*b* as the drive shaft 63 is driven, to thereby move the feed rollers 51 up and down between their operative and inoperative positions.

Considering the arms 60*a*, 60*b* which support the separator claws, the arrangement is such that as the roller support arms 49*a*, 49*b* rock toward the operative or feed position, the arms 60*a*, 60*b* are rocked by the bulges 49*a*A, 49*b*A in delayed relationship with respect to the rocking motion of the stop support levers 55*a*, 55*b*, thereby depressing the separator claws 49*a*, 49*b* slightly against the resilience of the coiled spring 46 which acts thereon through the placement plate 45, the stack of record sheets 3 and the claws 47*a*, 47*b*. As the claws 47*a*, 47*b* are depressed, an uppermost one or ones of the record sheets 3 will be similarly depressed, but the abutment of the feed rollers 51 against the record sheets 3, through the interposed extra sheet 2, with a suitable pressure assures a normal feeding operation.

It is to be noted that in the feed position of the feed rollers 51, the upper end of the stops 52*a*, 52*b* is flush with or below the upper surface of the separator claws 47*a*, 47*b*.

The purpose of rocking the separator claws 47*a*, 47*b* up and down in response to a vertical movement of the feed rollers 51 is to prevent any likelihood of jamming of an extra sheet 2 which may find its way into a clearance between the topmost level of the record sheets 3 and the separator claws when the stack of record sheets 3 is depressed under the pressure exerted by the feed rollers 51.

With the extra sheet feeder thus constructed, when the feed rollers 51 are in their inoperative position shown in FIG. 10, the stops 52*a*, 52*b* project above the upper surface of the cassette 41, so that an extra sheet 2 can be easily loaded in place. On the other hand, when the feed rollers 51 descend to their feed position shown in FIG. 11, the stops 52*a*, 52*b* duck into the body 41A of the cassette, followed by a rocking motion of the separator claws 47*a*, 47*b* to remove any clearance between them and an uppermost one of the record sheets 3, whereby a smooth feeding operation of the extra sheet 2 is assured.

In FIGS. 9 to 11, reference character 41B represents a top cover, and 48*a*, 48*b* pivot pins.

Figure 12:
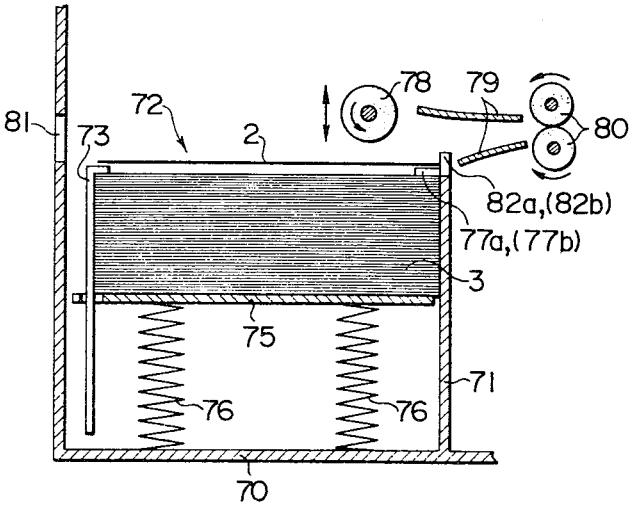
FIG. 12 is a fragmentary cross section of an extra sheet feeder according to still another embodiment of the invention.

FIG. 12 shows still another embodiment of the invention which is applicable to a copying machine which does not utilize a sheet cassette but in which a stack of record sheets 3 is disposed in a given chamber within the machine. The extra sheet feeder of this embodiment is designed to permit an extra sheet 2 to be easily loaded in place so that its leading edge is aligned with the position of the leading edge of normal copy sheets. Specifically, a copying machine 70 is shown with a chamber 72 receiving copy sheets therein, which is defined by a wall 71 integral with other walls of the machine. A placement plate 75 is slidably disposed within the chamber 72 and is upwardly urged by coiled compression springs 76, and a stack of record sheets 3 is placed on the plate 75. A pair of separator claws 77*a*, 77*b* are formed integrally with the upper end of the wall 71, and when the both lateral edges of a front portion of an uppermost record sheet in the stack bear against these claws, a further movement of the stack is prevented. A weight 73 rests on the upper rear end of the stack to impose a suitable load thereon, thus preventing the stack from being collapsed while permitting an uppermost record sheet to be easily removed out of the load imposed by the weight member 73.

It will be noted that in regions corresponding to the both lateral edges of the record sheets 3, the upper end of the wall 71 project upwardly beyond the separator claws 77*a*, 77*b* to serve as stops 82*a*, 82*b* for an extra sheet 2. An opening 81 for insertion of an extra sheet is formed in the surrounding wall of the machine 70 at a location corresponding to the rear end of the record sheets 3 disposed within the chamber 72.

In the feeder thus constructed, when a feed roller 78 is in its inoperative position, an extra sheet 2 may be inserted through the opening 81 and can be easily loaded in place by feeding it forward until its leading edge bears against the stops 82*a*, 82*b*.

With this arrangement, it is unnecessary to load an extra sheet 2 below the separator claws 77*a*, 77*b* which bear against an uppermost one of record sheets 3 disposed in the stack, but the extra sheet can be simply loaded in place by inserting it into abutment against the stops 82*a*, 82*b* located above the separator claws 77*a*, 77*b*.

It should be understood that the invention is not limited to the individual embodiments described above, but that a variety of changes and modifications are possible. By way of example, instead of disposing the stops along the both lateral edges of the copy sheets at a position corresponding to the leading edge thereof as shown in the described embodiments, a single stop may be disposed. The guide ledge which is used to guide and position an extra sheet may be omitted depending on the need of a particular use. Where the rear end of a container which contains record sheets therein is visible as when a cassette is used, such rear end may be provided with a linear array of indication marks along which a lateral side of an extra sheet is to be aligned. However, where a high accuracy is required in the positioning of the leading edge and the lateral side of an extra sheet and a single positioning stop is provided, it is desirable that a guide ledge be provided along the side on which the positioning stop is disposed in combination with an indication mark to assure an accurate positioning of the extra sheet. Means which cause the stops to retract or duck to their inoperative position in response to a feeding operation by the feed rollers may comprise a cam member which is mechanically ganged with a rocking motion of the feed support arms to cause the stops to duck into the cassette. Where the copying machine is provided with a chamber in which to receive record sheets, a solenoid or a linkage may be operated in response to a feeding operation by the feed rollers to retract the stops to a position above the record sheet containing chamber.

What is claimed is:

1. An extra sheet feeder for a copying machine comprising a feed mechanism disposed to be movable toward and away from a stack of record sheets in a container for movement into engagement with an uppermost one of the record sheets in the stack to remove it from the container, an uppermost stop against which the uppermost sheet of said stack may be biased, means defining a path disposed above the stack of record sheets and into which an extra sheet not associated with said stack can be inserted, and a positioning member, separate from said uppermost stop and stationary with respect thereto, against which the front edge of said extra sheet may be abutted, said positioning member being located above said uppermost stop and at the forward end of said path to position an inserted extra sheet at a feed position.

2. An extra sheet feeder according to claim 1 in which said container is a cassette and a pair of said positioning members are disposed along opposite lateral edges of a front end of the cassette so as to project above the latter.

3. An extra sheet feeder according to claim 2 in which said positioning members are integrally formed with the cassette to extend therefrom in an upward direction.

4. An extra sheet feeder according to claim 1 in which said container is a cassette which is integrally formed with a guide ledge which serves to guide and position an extra sheet as the latter is inserted.

5. An extra sheet feeder according to claim 1 in which a pair of said positioning members are located at the inner end of the container along opposite lateral edges thereof so as to project above a separator claw or claws integrally formed with said chamber, said separator claw or claws defining said uppermost stop.

6. An extra sheet feeder according to claim 5 in which said positioning members are formed integrally with a wall of the copying machine which defines said chamber to project therefrom.

7. An extra sheet feeder according to claim 1 in which said container comprises a chamber, the wall of which is integrally formed with a ledge, located adjacent to either side of record sheets contained therein, for guiding and positioning an extra sheet as it is being inserted.

8. An extra sheet feeder for a copying machine comprising: a feed mechanism disposed to be moved toward and away from a stack of record sheets in a container for movement into engagement with an uppermost one of the record sheets in the stack to remove it from the container; a path disposed above the stack of record sheets and into which an extra sheet not associated with the stack can be inserted; and a pair of positioning members located at the forward end of said path to position an inserted extra sheet at a feed position, said positioning members being disposed along both lateral edges of a front end of said cassette so as to project above the latter, said positioning members being integrally formed with a support member which is operated by said feed mechanism, said support member comprising a stop support lever which is rockably mounted on the inside of a side wall of said cassette and urged in one direction, said lever being rocked in response to movement of said feed mechanism into contact with said uppermost sheet so as to retract said positioning members into said cassette from their normal position projecting above the cassette.

9. An extra sheet feeder for a copying machine comprising: a feed mechanism disposed to be movable toward and away from a stack of record sheets in a container for movement into engagement with an uppermost one of the record sheets in said stack to remove it from said container; a path disposed above said stack of record sheets and into which an extra sheet not associated with said stack can be inserted; and a pair of positioning members located at the forward end of said path to position an inserted extra sheet at a feed position, said positioning members being located at the inner end of said container along both lateral edges thereof so as to project above a separator claw or claws integrally formed with said container, said positioning members being integrally formed with respective support member, said support members being operated by said feed mechanism so as to move said positioning members out of their operative position where they block a further movement of an extra sheet when said feed mechanism is lowered into contact with said stock.

10. An extra sheet feeder for a copying machine, comprising:

a container having a sheet receiving recess for receiving a stack of sheets, said sheet receiving recess having a front edge member for positioning the front edge of said stack of sheets and a top edge member stationary with respect to said container and defining an uppermost height of said stack;

a feed mechanism movable toward and away from said recess such that said feed mechanism can be moved into contact with an uppermost sheet of said stack when said stack of sheets is located in said recess, said feed mechanism being adapted to remove said uppermost sheet from said container;

a surface forming part of said container and located above said recess for supporting an extra sheet not associated with said stack; and positioning means including a stop againt which the front edge of said extra sheet may be abutted for locating said extra sheet at a feed position in which said extra sheet is contacted by said feed mechanism when said feed mechanism is moved toward said stack, said stop being located above said uppermost height and being stationary with respect to said top edge member, said feed mechanism removing said extra sheet from said surface along a predetermined path.

11. An extra sheet feeder as claimed in claim 10, wherein said positioning means is located along said path upstream of said extra sheet.

12. An extra sheet feeder as claimed in claim 11, wherein said positioning means includes a pair of stops disposed along opposite lateral edges of a front end of said container so as to project above said surrface.

13. An extra sheet feeder as claimed in claim 12, wherein said stops are integrally formed with said container.

14. An extra sheet feeder for a copying machine comprising:

a container having a sheet receiving recess for receiving a stack of sheets;

a feed mechanism movable toward and away from said recess such that said feed mechanism can be moved into contact with an uppermost sheet of said stack when said stack of sheets is located in said recess, said feed mechanism adapted to remove said uppermost sheet from said container;

a surface forming part of said container and located above said recess for supporting an extra sheet not associated with said stack;

positioning means for locating said extra sheet at a feed position in which said extra sheet is contacted by said feed mechanism when said feed mechanism is moved towards said stack, said positioning means normally extending above said surface; and means for withdrawing said positioning means into a position located below said surface when said feed mechanism is moved into contact with said uppermost sheet of said stack.

15. An extra sheet feeder as claimed in claim 14, wherein said withdrawing means comprises a support lever integrally formed with said positioning means and rockably mounted on said container, said support lever being normally biased in a first direction which causes said positioning means to be located above said surface, said support lever being rocked by said feed mechanism when said feed mechanism is moved into contact with said uppermost sheet by a sufficient amount to withdraw said positioning means into said position located below said surface.

16. An extra sheet feeder for a copying machine comprising a feed mechanism disposed to movable toward and away from a stack of record sheets contained in a cassette for movement into engagement with an uppermost one of the record sheets in the stack to remove it from the cassette, a path disposed above the stack of record sheets and into which an extra sheet not associated with the stack can be inserted, and a pair of positioning members located at the forward end of said path to position an inserted extra sheet at a feed position, said positioning members being integrally formed with a support member which is operated by said feed mechanism, said support member retracting said positioning members into said cassette from their normal position projecting above said cassette when said feed mechanism is moved into contact with said uppermost sheet.

17. An extra sheet feeder according to claim 16 in which said support member comprises a stop support lever which is rockably mounted on the inside of a sidewall of the cassette and urged in one direction, the lever being rocked in response to a movement of said feed mechanism into contact with said uppermost sheet.

18. An extra sheet feeder for a copying machine comprising a feed mechanism disposed to be movable toward and away from a stack of record sheets in a container for movement into engagement with an uppermost one of the record sheets in the stack to remove it from the container, a path disposed above the stack of record sheet and into which an extra sheet not associated with said stack can be inserted, and a pair of positioning members located at the forward end of said path to position an inserted extra sheet at said feed position, said pair of position members being located at the inner end of said container along opposite lateral edges thereof so as to project above a separator claw or claws integrally formed with said chamber, said positioning members being integrally formed with a support member which is operated by said feed mechanism so as to be moved out of their operative positions when they block a further movement of an extra sheet when said feed mechanism is operative.

19. An extra sheet feeder for a copying machine, comprising:

a container having a sheet receiving recess for receiving a stack of sheets;

a feed mechanism movable toward and away from said recess such that said feed mechanism can be moved into contact with an uppermost sheet of said stack when said stack of sheets is located in said recess, said feed mechanism being adapted to remove said uppermost sheet from said container;

a surface forming part of said container and located above said recess for supporting an extra sheet not associated with said stack;

positioning means including a stop for locating said extra sheet at a feed position in which said extra sheet is contacted by said feed mechanism when said feed mechanism is moved toward said stack, said feed mechanism removing said extra sheet from said surface along a predetermined path, said positioning means being located along said path upstream of said extra sheet and including a pair of stops disposed along opposite lateral edges of a front end of said container so as to project above said surface; and means for withdrawing said stops into said container to a position below said surface when said feed mechanism is moved into contact with said uppermost sheet.

20. An extra sheet feeder according to claim 19, wherein said withdrawing means comprises a pair of stop support levers connected to associated said stops, each of said support levers being mounted to said container and biased in a direction which will move said stops into said upper position, said levers being rocked into a position which causes said stops to withdraw into said container by said feed mechanism when said feed mechanism is moved into contact with said uppermost sheet.

* * * * *